US012405048B2

(12) United States Patent
Huang et al.

(10) Patent No.: US 12,405,048 B2
(45) Date of Patent: Sep. 2, 2025

(54) LOCKER WITH VALVE ASSEMBLY

(71) Applicants: Weihai New Beiyang Digital Technology Co. Ltd., Shandong (CN); Shandong New Beiyang Information Technology Co. Ltd., Shandong (CN)

(72) Inventors: Daqing Huang, Shandong (CN); Jiansong Liu, Shandong (CN); Tianxin Jiang, Shandong (CN)

(73) Assignees: WEIHAI NEW BEIYANG DIGITAL TECHNOLOGY CO., LTD., Shandong (CN); SHANDONG NEW BEIYANG INFORMATION TECHNOLOGY CO., LTD., Shandong (CN)

( * ) Notice: Subject to any disclaimer, the term of this patent is extended or adjusted under 35 U.S.C. 154(b) by 894 days.

(21) Appl. No.: 17/629,755

(22) PCT Filed: Jul. 23, 2020

(86) PCT No.: PCT/CN2020/103821
§ 371 (c)(1),
(2) Date: Jan. 24, 2022

(87) PCT Pub. No.: WO2021/013223
PCT Pub. Date: Jan. 28, 2021

(65) Prior Publication Data

US 2022/0252322 A1 Aug. 11, 2022

(30) Foreign Application Priority Data

Jul. 25, 2019 (CN) ..... 201910680455.5

(51) Int. Cl.
*F25D 11/02* (2006.01)
*F25D 17/04* (2006.01)
*F25D 31/00* (2006.01)

(52) U.S. Cl.
CPC ..... *F25D 17/045* (2013.01); *F25D 11/02* (2013.01); *F25D 31/005* (2013.01)

(58) Field of Classification Search
CPC ..... F25D 17/045; F25D 11/02; F25D 31/005; F25D 13/02; F25D 13/00
(Continued)

(56) References Cited

U.S. PATENT DOCUMENTS 1,726,631 A * 9/1929 Shipman ..... F25D 23/02 62/265
2,449,101 A * 9/1948 Barley ..... F25D 25/028 62/331
(Continued)

FOREIGN PATENT DOCUMENTS

CN 1207486 A 2/1999
CN 100545556 C 9/2009
(Continued)

OTHER PUBLICATIONS

First Office Acton issued in Chinese Patent Application No. 201910680455.5 dated Jul. 6, 2021.
(Continued)

*Primary Examiner* — Avinash A Savani
*Assistant Examiner* — Ryan L Faulkner
(74) *Attorney, Agent, or Firm* — Mark H. Whittenberger; Holland & Knight LLP

(57) ABSTRACT

A locker with a valve assembly includes a locker body and an air supply assembly disposed on the locker body. A main air duct communicating with the air supply assembly is disposed inside the locker body. The locker body includes at least one storage box. The storage box includes a box body, a box door and a valve assembly. The box body includes a sidewall that surrounds a circle and further includes an inner wall connected to the rear end of the sidewall. The front end
(Continued)

of the sidewall forms an opening. The sidewall is provided with an air vent communicating with the main air duct. The box door has a closed position for closing the opening, and an open position for opening the opening. The valve assembly includes a valve and a reset member. The valve is configured to move relative to the sidewall.

17 Claims, 7 Drawing Sheets

(58) Field of Classification Search
USPC ..... 454/183
See application file for complete search history.

(56) References Cited

U.S. PATENT DOCUMENTS

| | | | | | |
|---|---|---|---|---|---|
| 2,826,475 | A * | 3/1958 | Larson | F25D 13/02 | 312/236 |
| 3,089,313 | A * | 5/1963 | Fix | F25D 13/02 | 296/181.6 |
| 5,941,087 | A * | 8/1999 | Lee | F25D 17/045 | 62/186 |
| 6,067,811 | A * | 5/2000 | Shih | A23B 7/148 | 62/302 |
| 2004/0035142 | A1* | 2/2004 | Yoon | F25D 23/10 | 62/298 |
| 2014/0137574 | A1* | 5/2014 | Hothi | F25D 13/02 | 62/62 |

FOREIGN PATENT DOCUMENTS

| | | | |
|---|---|---|---|
| CN | 205245666 | U | 5/2016 |
| CN | 205505562 | U | 8/2016 |
| CN | 205621171 | U | 10/2016 |
| CN | 106546055 | A | 3/2017 |
| CN | 107240197 | A | 10/2017 |
| CN | 107726699 | A | 2/2018 |
| CN | 108332482 | A | 7/2018 |
| CN | 208477664 | U | 2/2019 |
| CN | 208541168 | U | 2/2019 |
| CN | 208998418 | U | 6/2019 |
| CN | 209054831 | U | 7/2019 |
| JP | H0-5196342 | A | 8/1993 |
| KR | 19980083396 | A | 12/1998 |
| WO | 2017084332 | A1 | 5/2017 |

OTHER PUBLICATIONS

Second Office Acton issued in Chinese Patent Application No. 201910680455.5 dated Dec. 30, 2021.

Search Report issued in Chinese Patent Application No. 201910680455.5, downloaded from the Internet May 31, 2022.

Supplemental Search Report issued in Chinese Patent Application No. 201910680455.5, downloaded from the Internet May 31, 2022.

International Search Report issued in International Application No. PCT/CN2020/103821, mailed Sep. 29, 2020.

International Search Report issued in Application Serial No. PCT/CN2020103821 on Jun. 23, 2023.

* cited by examiner

LOCKER WITH VALVE ASSEMBLY

RELATED APPLICATIONS

The subject application is a U.S. National Stage application of International Application No. PCT/CN2020/103821, filed on 23 Jul. 2020, which claims the priority of Chinese Patent Application No. 201910680455.5, filed on 25 Jul. 2019. The contents of which are herein incorporated by reference in their entirety.

This application claims priority to Chinese Patent Application No. 201910680455.5 filed with the China National Intellectual Property Administration (CNIPA) on Jul. 25, 2019, the disclosure of which is incorporated herein by reference in its entirety.

TECHNICAL FIELD

The present application relates to the field of item storage technology, for example, a locker with a valve assembly.

BACKGROUND

To satisfy the storage requirements of fruits, vegetables, meat, aquatic products or meals that require refrigeration and heat preservation, some lockers are provided with a refrigeration assembly or a heating assembly in a locker body. However, in the actual use of these lockers, an operator may forget to close the door after taking out items. Therefore, cold air or hot air is prone to loss. As a result, energy is wasted.

SUMMARY

The present application provides a locker with a valve assembly to alleviate the problem of easy loss of cold air or hot air in a case where an operator forgets to close the door of the locker.

The locker with a valve assembly according to the present application includes a locker body and an air supply assembly disposed on the locker body. A main air duct communicating with the air supply assembly is disposed inside the locker body. The locker body includes at least one storage box. Each storage box includes a box body, a box door and a valve assembly. The box body includes a sidewall that surrounds a circle and further includes an inner wall connected to the rear end of the sidewall. The front end of the sidewall forms an opening. The sidewall is provided with an air vent communicating with the main air duct. The box door has a closed position for closing the opening, and an open position for opening the opening. The valve assembly includes a valve and a reset member. The valve is configured to move relative to the sidewall.

When the box door is located at the closed position, the box door is configured to drive the valve to open the air vent. When the box door is located at the open position, the reset member is configured to drive the valve to close the air vent.

REFERENCE LIST

Figure 1:
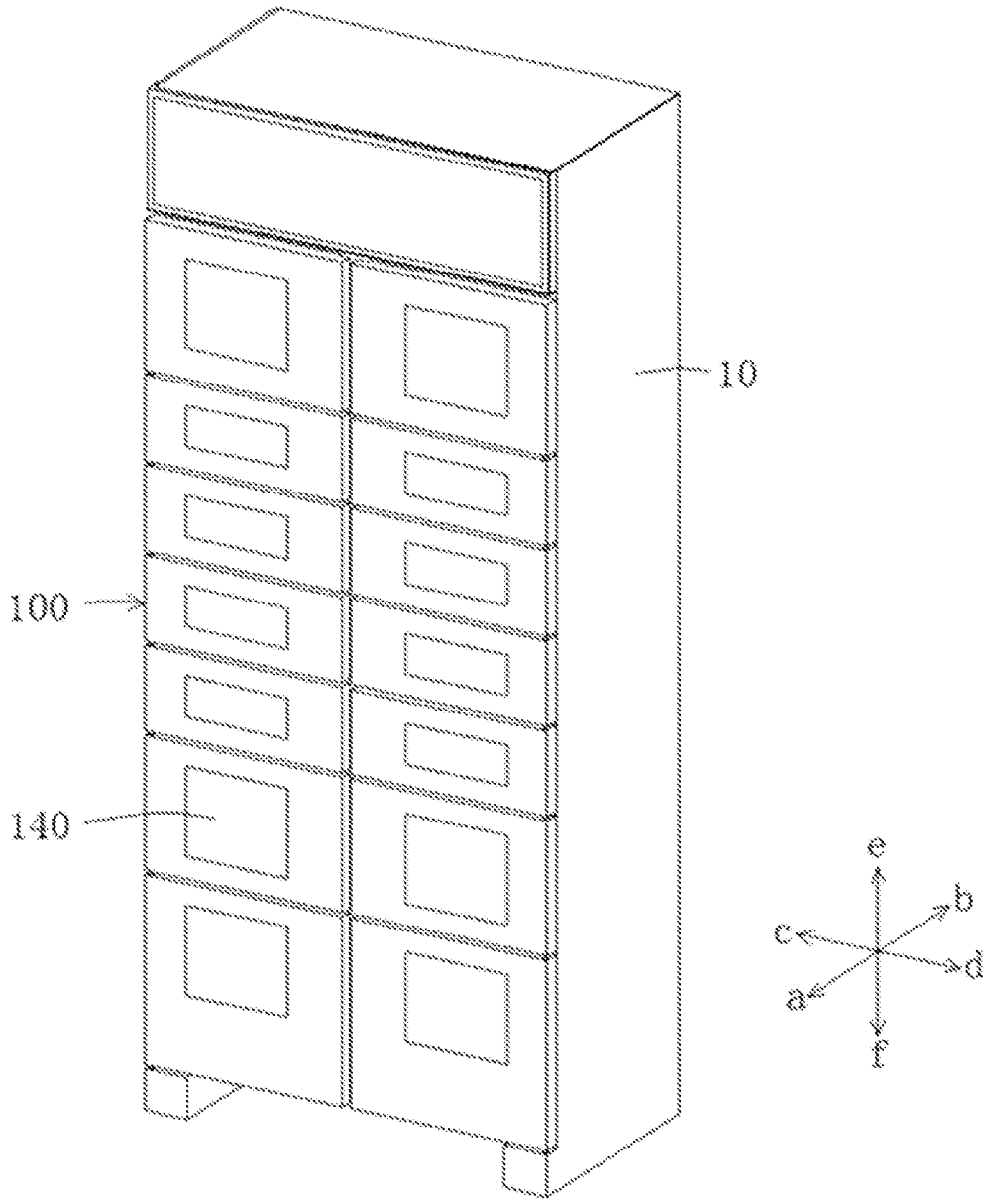
FIG. 1 is a structural schematic view of a locker with a valve assembly according to embodiment one of the present disclosure.

10 locker body
20 air supply assembly
100 storage box
110 first sidewall
111 air inlet vent
112 air outlet vent
113 limiting member
114 safety lock
120 second sidewall
130 inner wall
131 second mounting hole
140 box door
150 valve
151 air inlet hole
152 air outlet hole
153 first mounting part
154 second mounting part
155 first end
156 second end
157 main body
160 reset member
170 pivot
180 first valve assembly
190 second valve assembly
158 limiting groove
310 housing
311 first plate
312 second plate
313 third plate
314 hook
320 positioning pin
200 main air duct
210 air inlet duct
220 air return duct

DETAILED DESCRIPTION

Solutions of the present application are clearly and completely described below with reference to embodiments.

In the description of the present application, it is to be noted that orientations or positional relations indicated by terms such as "front", "rear", "up", "down", "left" and "right" are based on the drawings. These orientations or positional relations are intended only to facilitate and simplify the description of the present application and not to indicate or imply that a device or element referred to must have such particular orientations or must be configured or operated in such particular orientations. Thus, these orientations or positional relations are not to be construed as limiting the present application. Moreover, terms like "first" and "second" are merely for description and are not to be construed as indicating or implying relative importance.

It is to be noted that in the embodiments, the direction indicated by the ab arrow in a figure represents the front-rear direction; the direction indicated by the cd arrow in the figure represents the left-right direction; and the direction indicated by the of arrow in the figure represents the up-down direction.

Embodiment One

Figure 2:
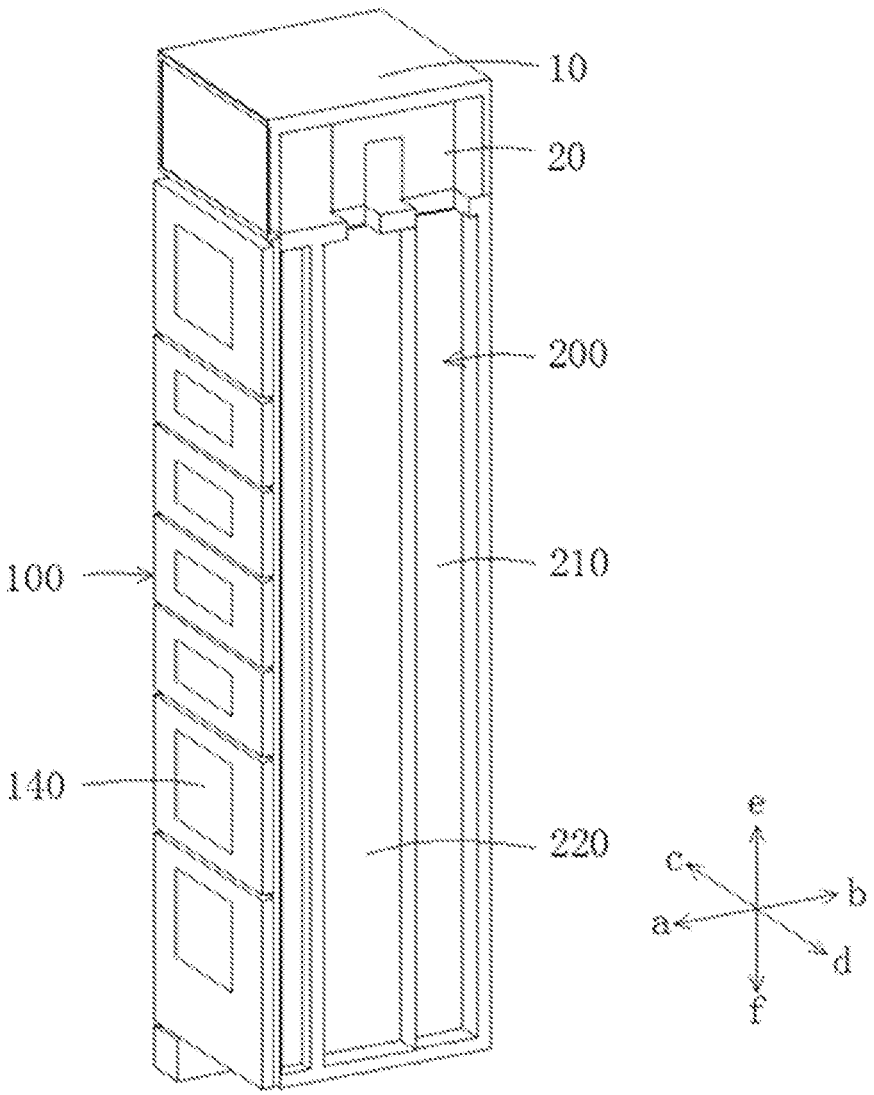
FIG. 2 is a sectional structural schematic view of the locker with a valve assembly according to embodiment one of the present disclosure.
Figure 3:
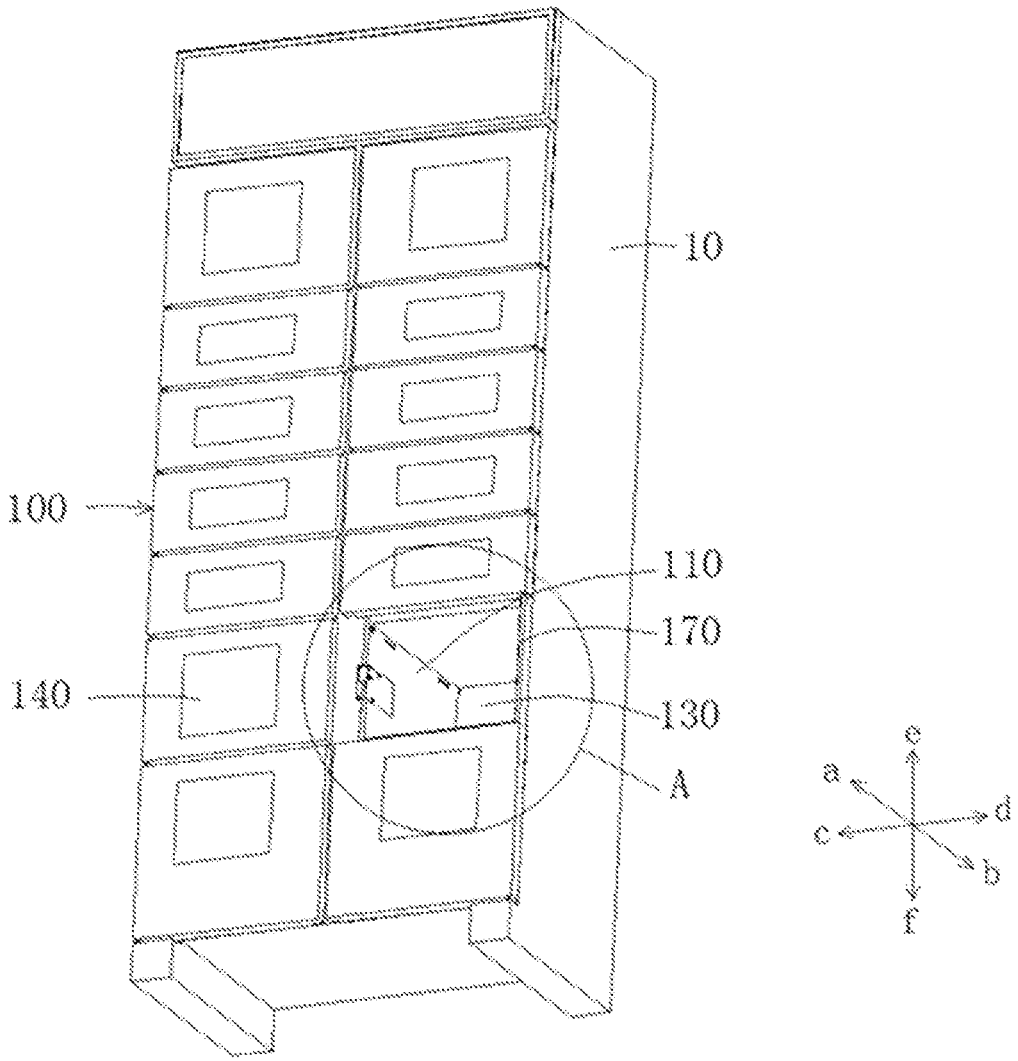
FIG. 3 is a structural schematic view taken from another angle of the locker with a valve assembly according to embodiment one of the present disclosure.

FIG. 1 is a structural schematic view of a locker with a valve assembly according to this embodiment. FIG. 2 is a sectional structural schematic view of the locker with a valve assembly according to this embodiment. FIG. 3 is a structural schematic view taken from another angle of the locker with a valve assembly according to embodiment one of the present disclosure.

Figure 4:
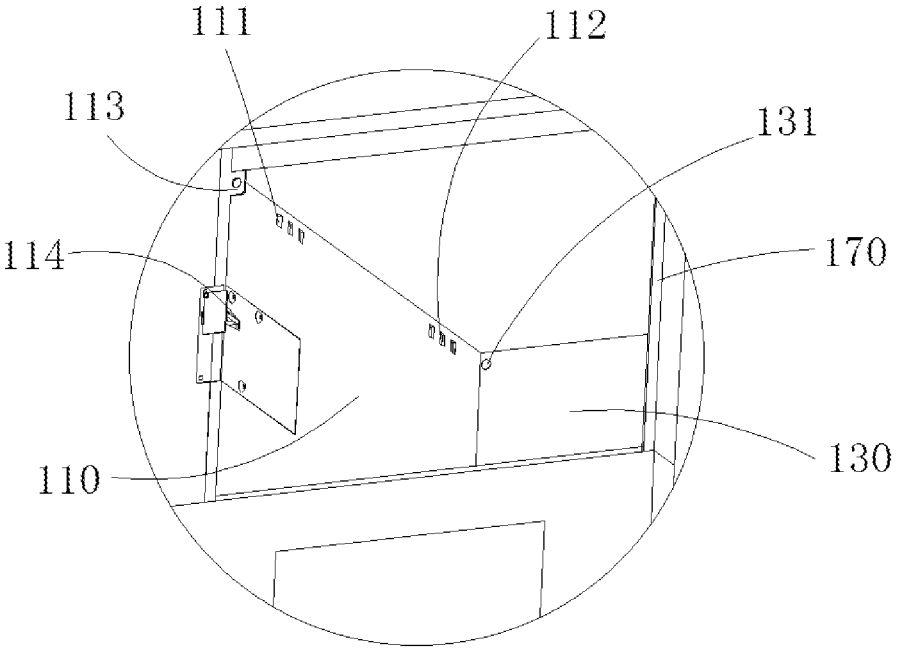
FIG. 4 is an enlarged partial view of the structure of part A of FIG. 3.
Figure 5:
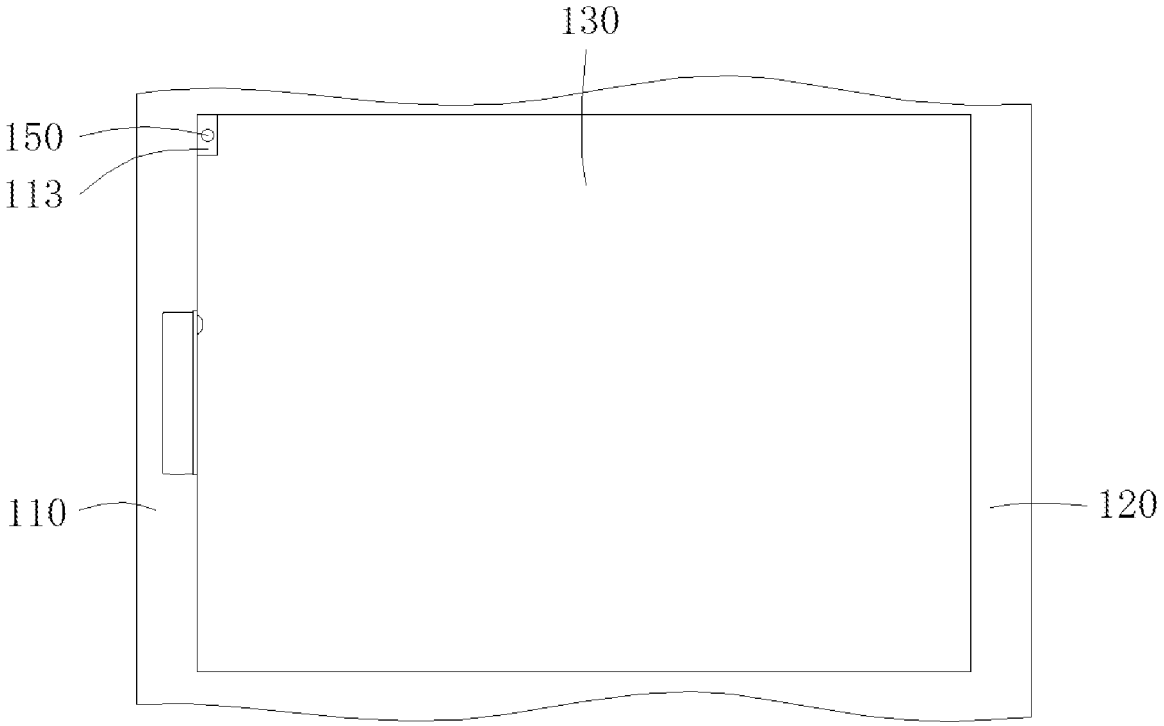
FIG. 5 is a front view of a partial structure of a storage box of the locker with a valve assembly according to embodiment one of the present disclosure.
Figure 6:
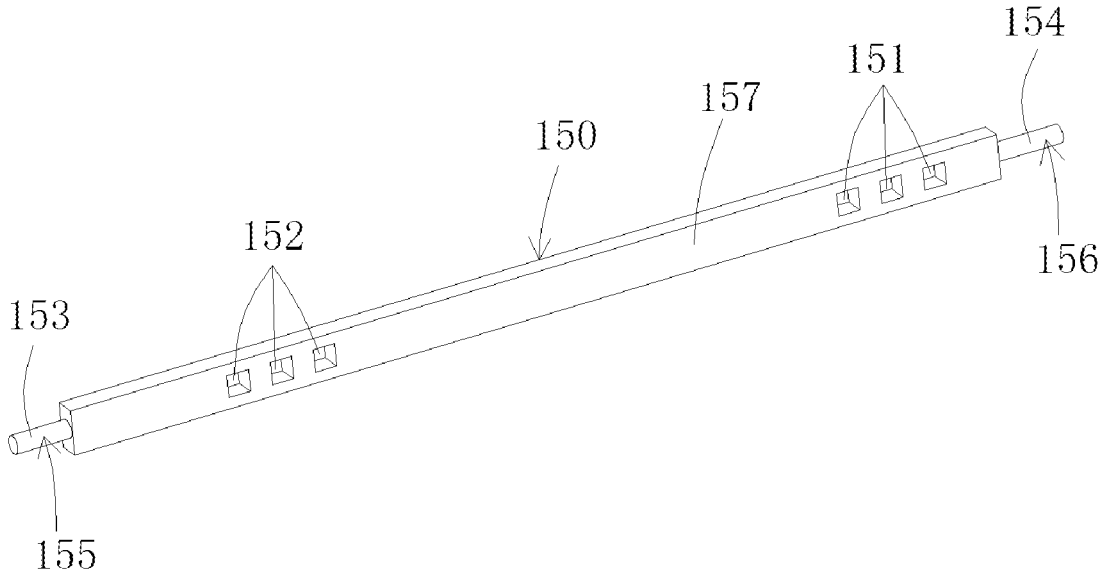
FIG. 6 is a view illustrating the structure of a valve of the locker with a valve assembly according to embodiment one of the present disclosure.
Figure 7:
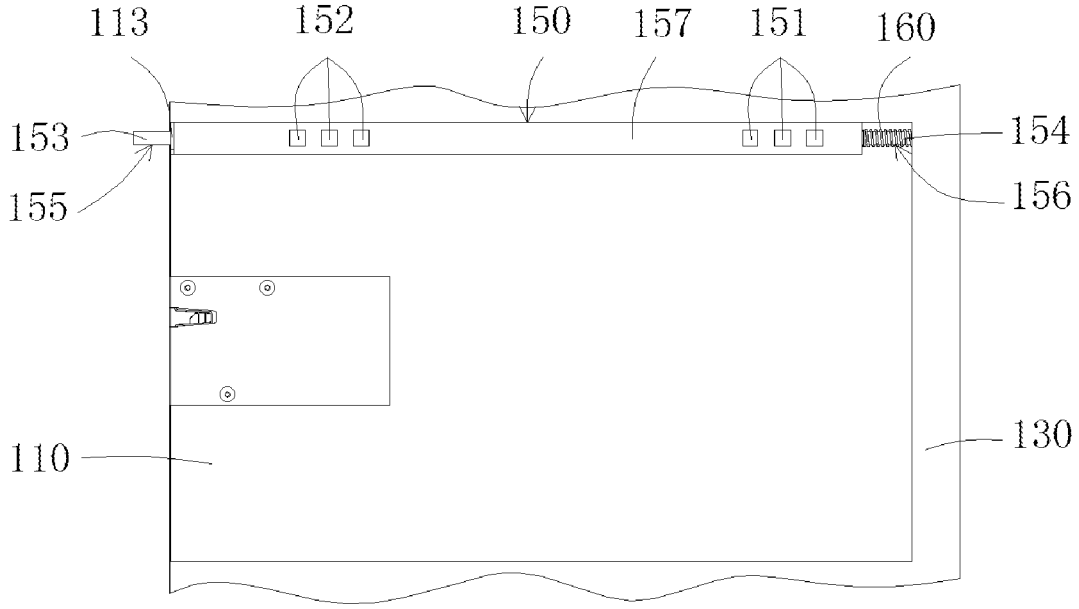
FIG. 7 is a side view of the storage box of the locker with a valve assembly when the box door of the storage box is open according to embodiment one of the present disclosure.

As shown in FIGS. 1 to 3, a locker with a valve assembly according to this embodiment includes a locker body 10 and an air supply assembly 20 disposed on the locker body 10. A main air duct 200 communicating with the air supply assembly 20 is disposed inside the locker body 10. The locker body 10 includes at least one storage box 100. Each storage box 100 includes a box body, a box door 140 and a valve assembly. The box body includes a sidewall that surrounds a circle and further includes an inner wall 130 connected to the rear end of the sidewall. The front end of the sidewall forms an opening. The sidewall is provided with an air vent communicating with the main air duct 200. The box door 140 is movably connected to the box body and has a closed position for closing the opening, and an open position for opening the opening. FIG. 4 is an enlarged partial view of the structure of part A of FIG. 3. FIG. 5 is a front view of a partial structure of a storage box of the locker with a valve assembly according to this embodiment. FIG. 6 is a perspective view illustrating the structure of a valve of the locker with a valve assembly according to this embodiment. FIG. 7 is a side view of the storage box of the locker with a valve assembly when the box door of the storage box is open according to embodiment one of the present disclosure. As shown in FIGS. 4 to 7, the valve assembly includes a valve 150 and a reset member 160. The valve 150 is configured to move relative to the sidewall. When the box door 140 is located at the closed position, the box door 140 is configured to drive the valve 150 to open the air vent. When the box door 140 is located at the open position, the reset member 160 is configured to drive the valve 150 to close the air vent.

Continuing to refer to FIG. 4, the storage box 100 further includes a safety lock 114. The safety lock 114 is disposed between the box body and the box door 140, and is configured to lock the box door 140 in the closed position.

During the use of the locker with a valve assembly according to this embodiment, when the box door 140 of the storage box 100 is closed, the box door 140 is configured to drive the valve 150 to open the air vent. The air vent communicates with the main air duct 200. The air supply assembly 20 is configured to send air (such as cold air or hot air) into the main air duct 200. The air enters the box body through the air vent. The box door 140 is configured to prevent the loss of the air from the opening to an external environment. When the box door 140 of the storage box 100 is open, the reset member 160 is configured to drive the valve 150 to close the air vent to prevent the air in the main air duct 200 from entering the box body through the air vent and further losing to the external environment from the opening. In this manner, the problem of air loss in the main air duct 200 in a case where an operator forgets to close the door is effectively alleviated. Thus, energy is saved. Moreover, cost is also reduced since a requirement for an additional driving mechanism of the valve 150 is eliminated due to the force of closing the door.

In this embodiment, the air supply assembly 20 may be an individual refrigeration assembly, an individual heating assembly, or an assembly with dual functions of refrigeration and heating. For example, the air supply assembly 20 may be a structure similar to an air conditioner including an evaporator, an evaporator fan, a compressor, a condenser, and a condenser fan. The compressor, the condenser and the evaporator are sequentially in a pipeline connection to form a circuit. When refrigeration is required, the evaporator fan is configured to blow the air around the evaporator into the main air duct 200. At this time, the air is cold. The cold air may enter the inside of the box body from the main air duct 200 through the air vent to cool the items stored in the box body to achieve good storage of the items. When heating is required, the condenser fan is configured to blow the air around the condenser into the main air duct 200. At this time, the air is hot. Similarly, the hot air may enter the inside of the box body from the main air duct 200 through the air vent to heat the items stored in the box body to achieve the good storage of the items.

The refrigeration assembly or the heating assembly, or the assembly with the dual functions of refrigeration and heating is common in relevant technologies. This is not limited in the present application. As long as the cold air or the hot air can be sent to the main air duct 200.

In this embodiment, a plurality of storage boxes 100 may be divided into two columns and disposed in the locker body 10. The two columns of storage boxes 100 are bilaterally symmetric to each other. The main air duct 200 is disposed between the two columns of storage boxes 100. The air supply assembly 20 may simultaneously provide the cold air or the hot air to the left and right columns of storage boxes 100 through the main air duct 200 in the middle. In this manner, the volume of the locker body 10 is reduced, and the utilization of the space in the locker body 10 is improved.

In this embodiment, the shape of the storage box 100 may be a cuboid, that is, the box body of the storage box 100 includes four rectangular sidewalls connected in sequence and one rectangular inner wall.

The shape of the storage box 100 may also be other shapes. For example, the shape of the storage box 100 may also be cylindrical, that is, the box body of the storage box 100 includes one cylindrical sidewall and one circular inner wall. As long as a storage function can be achieved, and the disposition requirement of the valve assembly can be satisfied, the shape of the storage box 100 is not limited in the present application.

In this embodiment, the sizes of a plurality of storage boxes 100 may be different. As shown in FIGS. 1 to 3, the storage boxes 100 located in the middle have small accommodation space, and the storage boxes 100 located above and below have relatively large accommodation space. Therefore, the storage requirements of items with different volumes can be satisfied.

The number, size and arrangement of the storage boxes 100 may be combined in different ways according to requirements to satisfy different storage requirements.

Figure 8:
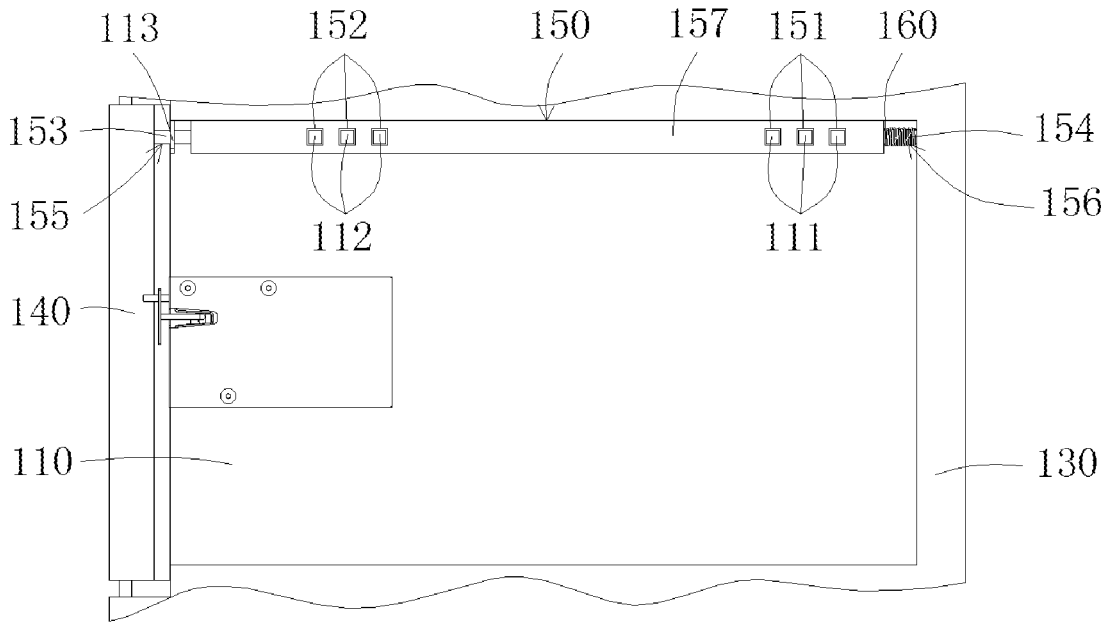
FIG. 8 is a side view of the storage box of the locker with a valve assembly when the box door of the storage box is closed according to embodiment one of the present disclosure.

In this embodiment, as shown in FIGS. 6 to 8, the valve 150 is movably connected to the sidewall. The valve 150 includes a first end 155 and a second end 156 in the moving direction of the valve 150 and further includes an air hole between the first end 155 and the second end 156 and a blocking part located between the first end 155 and the second end 156. The first end 155 is adjacent to the opening. The valve 150 has a first position for making the air hole opposite to the air vent, and a second position for making the blocking part opposite to the air vent. When the box door 140 is located at the closed position, the box door 140 is configured to abut against the first end 155 and make the valve 150 move to the first position. When the box door 140 is located at the open position, the reset member 160 is configured to drive the valve 150 to the second position. In this embodiment, the reset member 160 includes an elastic member. The elastic member is adjacent to the second end 156. One end of the elastic member is connected to the valve 150. Another end of the elastic member is connected to the inner wall 130. The elastic member is configured to make the valve 150 always have a tendency to move to the second position. With this configuration, the valve assembly is simple in structure and low in cost.

In this embodiment, continuing to refer to FIG. 6, the valve 150 includes a main body 157, a first mounting part 153 disposed at the first end 155, and a second mounting part 154 disposed at the second end 156. The air hole is disposed on the main body 157. The part of the main body 157 where the air hole is not disposed forms the blocking part. The box body further includes a limiting member 113 fixedly connected with the sidewall. The first mounting part 153 is connected to the limiting member 113 in an inserted manner. The second mounting part 154 is connected to the inner wall 130 in an inserted manner. When the box door 140 is located at the closed position, the first mounting part 153 is configured to abut against the box door 140. When the box door 140 is located at the open position, the elastic member is configured to drive the valve 150 to move towards the opening. This configuration makes it possible to avoid damage to the valve 150 due to the collision between the items, and the first end 155 of the valve 150 or the second end 156 of the valve 150, during the placement of the items into the storage box 100.

As shown in FIG. 4, the limiting member 113 is provided with a first mounting hole. The inner wall 130 is provided with a second mounting hole 131. The first mounting hole and the second mounting hole 131 are disposed opposite each other. The first mounting part 153 is inserted into the first mounting hole. The second mounting part 154 is inserted into the second mounting hole 131. Whether the valve 150 is located in the first position or the second position, the first mounting part 153 is always inserted into the first mounting hole, and the second mounting part 154 is always inserted into the second mounting hole 131. Thus, it is ensured that the valve 150 can be smoothly and stably switched between the first position and the second position.

In this embodiment, continuing to refer to FIG. 7, the second mounting part 154 is a strip-shaped structure that extends in a direction perpendicular to the inner wall 130. The elastic member is a compression spring. The compression spring sleeves on the second mounting part 154. One end of the compression spring and another end of the compression spring are configured to abut against the main body 157 and the inner wall 130 respectively. This configuration can make the structure of the valve assembly simple and compact.

In this embodiment, as shown in FIG. 5, the sidewall includes a first sidewall 110 and a second sidewall 120 disposed opposite to each other in the width direction of the box body (that is, the left-right direction in FIG. 5). The first sidewall 110 is adjacent to the main air duct 200. The air vent is disposed on the first sidewall 110. The valve 150 is movably connected to the first sidewall 110. As shown in FIGS. 4 and 8, the box door 140 is pivoted to the box body through a pivot 170. The pivot 170 is adjacent to the second sidewall 120. When the box door 140 is located at the closed position, the end of the box door 140 far away from the pivot 170 is configured to abut against the first end 155. Since the speed of the end of the box door 140 far away from the pivot 170 is the highest during the opening of the box door 140, with this configuration, the valve 150 can close the air vent more sensitively once the box door 140 is opened. Thus, the reliability of the valve 150 is improved. Moreover, under the action of the reset member 160, the valve 150 is configured to abut against the box door 140 outwards and assist in driving the box door 140 to open quickly. In this manner, user's experience is also improved.

The sidewall further includes a third sidewall and a fourth sidewall disposed opposite to each other in the height direction of the box body (that is, the up-down direction in FIG. 5). The first sidewall 110, the third sidewall, the second sidewall 120 and the fourth sidewall are connected in sequence. In other embodiments, a valve 150 may be movably connected to any one of the second sidewall 120, the third sidewall or the fourth sidewall.

In other embodiments, the pivot 170 may also be adjacent to the first sidewall, the third sidewall or the fourth sidewall. Alternatively, the pivot 170 may also be directly disposed on a sidewall to make the box door 140 pivoted to a box body. In other embodiments, the box door 140 may also be connected to the box body in a slidable manner. This is not limited in the present application.

In this embodiment, as shown in FIG. 2, the main air duct 200 includes an air inlet duct 210 and an air return duct 220. The air inlet duct 210 and the air return duct 220 extend in the up-down direction and are arranged in the front-rear direction. As shown in FIG. 4, the air vent on the sidewall includes an air inlet vent 111 and an air outlet vent 112. The air inlet vent 111 communicates with the air inlet duct 210. The air outlet vent 112 communicates with the air return duct 220. As shown in FIG. 6, the air hole includes an air inlet hole 151 and an air outlet hole 152. When the box door 140 is located at the closed position, the air inlet hole 151 is opposite to the air inlet vent 111, and the air outlet hole 152 is opposite to the air outlet vent 112. The cold air or the hot air sent by the air supply assembly 20 enters the box body through the air inlet duct 210, the air inlet vent 111 and the air inlet hole 151. The air in the box body returns to the air supply assembly 20 through the air outlet hole 152, the air outlet vent 112 and the air return duct 220. When the box door 140 is located at the open position, the air inlet vent 111 and the air outlet vent 112 are opposite to the blocking part to prevent the cold air or the hot air in the main air duct 200 from entering the box body. Therefore, the loss of the cold air or the hot air is avoided in the case where the box door 140 is open. This configuration can further simplify the structure of the valve assembly and reduce the cost.

In this embodiment, a plurality of air inlet vents 111 are arranged apart in the moving direction of the valve 150. The number of air inlet holes 151 is the same as the number of the air inlet vents 111. When the box door 140 is located at the closed position, each of the air inlet holes 151 is opposite to a respective one of a plurality of air inlet vents 111. A plurality of air outlet vents 112 are also arranged apart in the moving direction of the valve 150. The number of air outlet holes 152 is the same as the number of the air outlet vents 112. When the box door 140 is located at the closed position, each of the air outlet holes 152 is opposite to a respective one of a plurality of air outlet vents 112.

A plurality of air inlet vents 111 and a plurality of air inlet holes 151 are disposed, which increases the amount of inlet air, and accelerates the temperature change of the items in the box body, and is beneficial to maintain a good quality of the items. A plurality of air outlet vents 112 and a plurality of air outlet holes 152 are disposed, which increases the amount of return air, and air flow efficiency. Further, a guarantee is provided for maintaining the good quality of the items in the box body.

Embodiment Two

Figure 9:
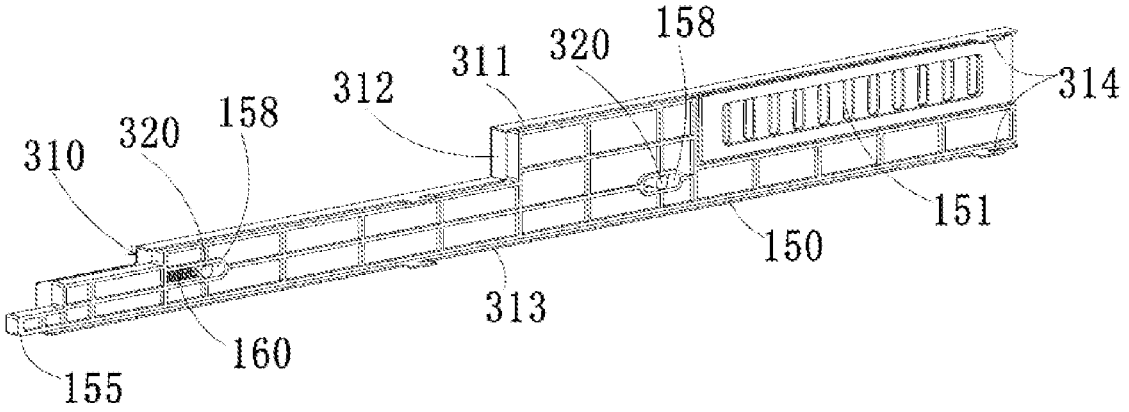
FIG. 9 is a partial structural schematic view of a storage box of a locker with a valve assembly according to embodiment two of the present disclosure.

FIG. 9 is a partial structural schematic view of a storage box of a locker with a valve assembly according to this embodiment. As shown in FIG. 9, in this embodiment, a sidewall is provided with a long groove extending in a direction perpendicular to an inner wall 130. A valve 150 is disposed in the long groove and configured to move between a first position and a second position along the long groove. The long groove is configured to support and guide the valve 150 and to make the valve 150 move smoothly between the first position and the second position along the long groove. Thus, the movement flexibility of the valve 150 is improved.

The sidewall includes a housing 310. The long groove is formed by the housing 310. The housing 310 includes a first plate 311, a second plate 312 and a third plate 313 vertically connected in sequence. The first plate 311 and the third plate 313 are disposed opposite to each other. The valve 150 is located between the first plate 311 and the third plate 313. Under the joint guidance of the first plate 311 and the third plate 313, the valve 150 can move more smoothly and stably.

The second plate 312 of the housing 310 is provided with a plurality of positioning pins 320. The valve 150 is provided with a plurality of limiting grooves 158. A plurality of limiting grooves 158 extend in the moving direction of the valve 150. Each of limiting grooves 158 sleeve on a respective one of a plurality of positioning pins 320. The reset member is a compression spring located in one limiting groove 158. One end of the compression spring is configured to abut against the inner wall of one limiting groove 158. Another end of the compression spring is configured to abut against the positioning pin 320. Under the action of the compression spring, the valve 150 always has a tendency to move to the first position. In this embodiment, the second plate 312 of the housing 310 is provided with two positioning pins 320. The valve 150 is provided with two limiting grooves 158.

When a box door 140 is located at a closed position, the box door 140 is configured to make the valve 150 move to the first position. At this time, the compression spring is compressed. An inlet hole 151 is opposite to an air inlet vent 111. The air inlet vent 111 communicates with an air inlet duct 210. When the box door 140 is located at an open position, under the action of an elastic restoring force of the compression spring, the valve 150 is configured to move to the second position where a blocking part is opposite to the air inlet vent 111. Therefore, the air inlet vent 111 is closed. Moreover, when the box door 140 is open, the force exerted by the box door 140 to the valve 150 disappears. At this time, under the action of the reset member 160, the valve 150 is reset, and the air inlet vent 111 is closed. This configuration ensures a stable state when the valve 150 is configured to move between the first position and the second position.

Moreover, the problem of loss of cold air or hot air in a main air duct 200 in the case where the operator forgets to close the door is effectively alleviated. Thus, the energy is saved.

The first plate 311 and the third plate 313 are each provided with a hook 314. The opening of the hook 314 faces the inner wall 130. Correspondingly, the sidewall is provided with a groove. The hook 314 is configured to engage with the groove in a snap-in manner. One end of the compression spring is configured to abut against the inner wall of the limiting groove 158 of the valve 150, and another end of the compression spring is configured to abut against the positioning pin 320. Therefore, under the action of the compression spring, the valve 150 always has a tendency to move to the second position. Under the action of the compression spring, the hook 314 of the housing 310 always maintains a tendency to engage with the groove in a snap-in manner. This configuration not only achieves a reliable guidance during the movement of the valve 150, but also ensures the reliability of the switching of the valve 150 between the first position and the second position. Moreover, under the action of the reset member 160, the configuration in which the housing 310 engages with the sidewall in a snap-in manner is maintained. Therefore, the mounting and the disassembly of the valve 150 can be completed without a fastener or a special tool. This configuration enables good assemblability and maintainability and simplifies the structure.

Embodiment Three

Figure 10:
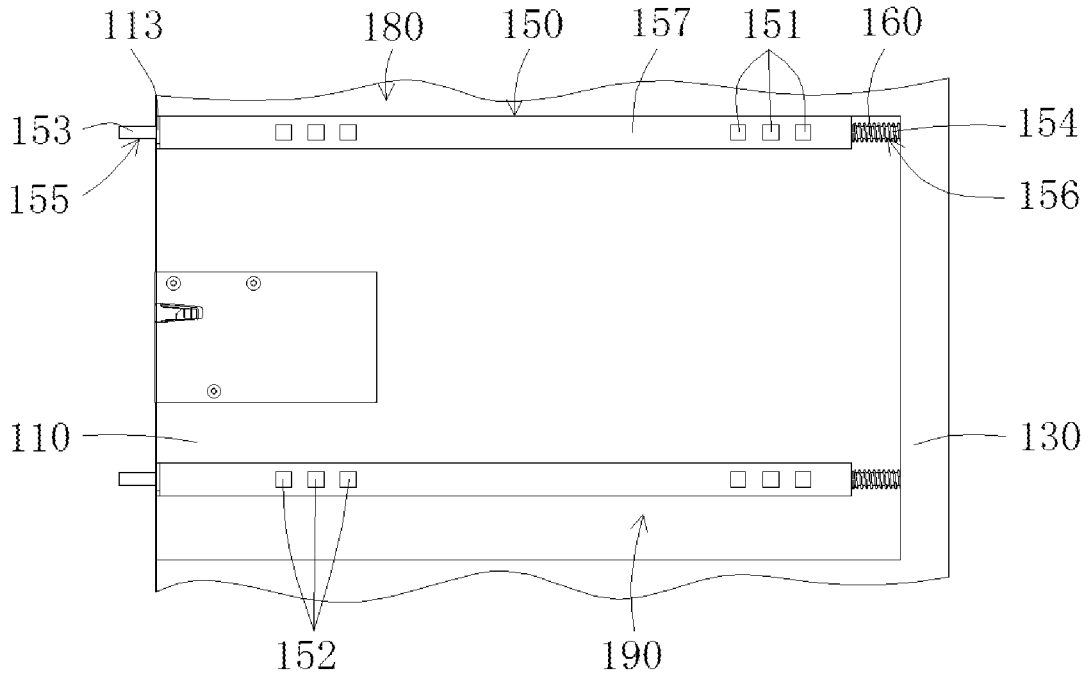
FIG. 10 is a side view of a storage box of a locker with a valve assembly when the box door of the storage box is open according to embodiment three of the present disclosure.
Figure 11:
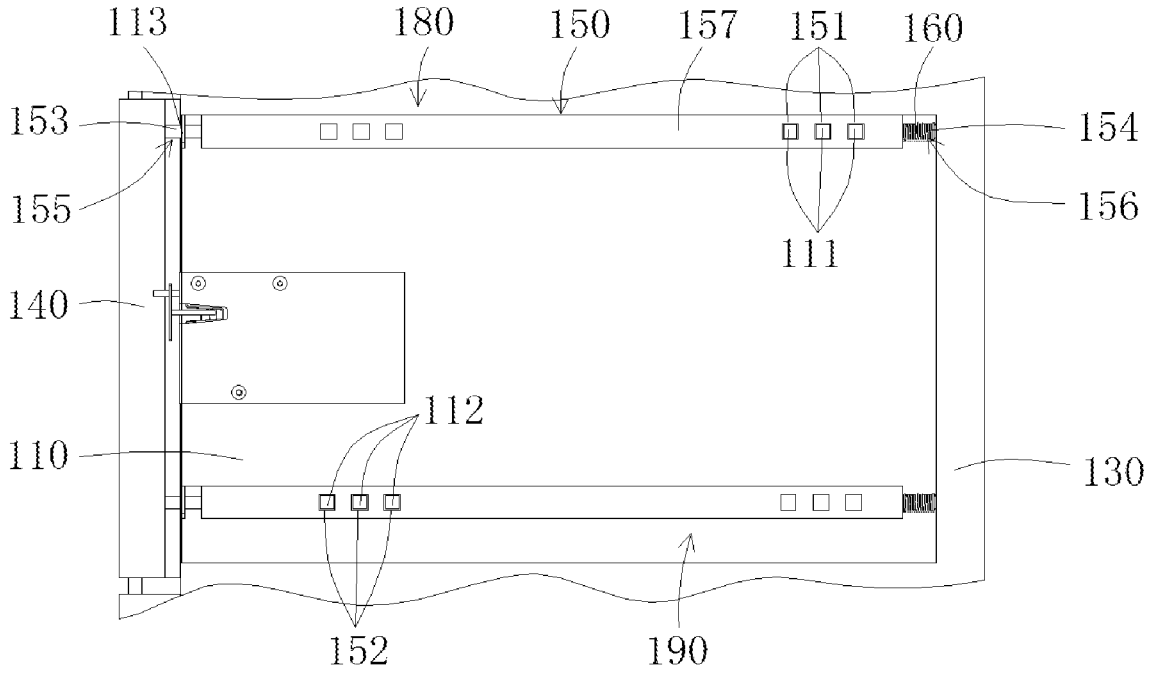
FIG. 11 is a side view of the storage box of the locker with a valve assembly when the box door of the storage box is closed according to embodiment three of the present disclosure.

FIG. 10 is a side view of a storage box of a locker with a valve assembly when the box door of the storage box is open according to this embodiment. FIG. 11 is a side view of the storage box of the locker with a valve assembly when the box door of the storage box is closed according to this embodiment. As shown in FIGS. 10 and 11, this embodiment provides another locker with a valve assembly. The difference between this locker with a valve assembly and embodiment one is that: an air inlet vent 111 and an air outlet vent 112 are disposed apart in a vertical direction; the valve assembly includes a first valve assembly 180 and a second valve assembly 190; when a box door 140 is located at a closed position, an air hole of the first valve assembly 180 is opposite to the air inlet vent 111, and an air hole of the second valve assembly 190 is opposite to the air outlet vent 112; and when the box door 140 is located at an open position, a blocking part of the first valve assembly 180 is opposite to the air inlet vent 111, and a blocking part of the second valve assembly 190 is opposite to the air outlet vent 112.

In use, when the box door 140 is closed, the box door 140 is configured to abut against a first end 155 of a valve 150 in the first valve assembly 180, and a first end 155 of a valve 150 in the second valve assembly 190. Therefore, two valves 150 are driven to move towards an inner wall 130. The air hole of the first valve assembly 180 is opposite to the upper air inlet vent 111. The air hole of the second valve assembly 190 is opposite to the lower air outlet vent 112. Thus, the inflow and outflow of cold air or hot air can be achieved. When the box door 140 is opened, in the first valve assembly 180, a reset member 160 is configured to drive the valve 150 to move towards the opening, and the blocking part of the valve 150 is configured to close the air inlet vent 111. In the second valve assembly 190, a reset member 160 is configured to drive the valve 150 to move towards the opening, and the blocking part of the valve 150 is configured to close the air outlet vent 112. Thus, the loss of cold air or hot air in a main air duct 200 is prevented.

In addition, the air inlet vent 111 and the air outlet vent 112 are disposed apart in the vertical direction to make the distance between the air inlet vent 111 and the air outlet vent 112 far. Thus, after the cold air or the hot air enters a box body through the air inlet vent 111 and before the cold air or the hot air flows out the box body through the air outlet vent 112, the cold air or the hot air can more fully exchange heat with air or items in the box body. Further, a refrigeration effect or a heating effect is improved.

Other features of this embodiment are the same as those of embodiment one. The technical effects of each solution have been described in embodiment one. Thus, the details are not repeated here.

What is claimed is:

1. A locker with a valve assembly, comprising a locker body and an air supply assembly disposed on the locker body, and a main air duct communicating with the air supply assembly is disposed inside the locker body; the locker body comprises at least one storage box, each of the at least one storage box comprises a box body, a box door and the valve assembly, the box body comprises a sidewall that surrounds a circle and further comprises an inner wall connected to a rear end of the sidewall, a front end of the sidewall forms an opening, and the sidewall is provided with an air vent communicating with the main air duct; the box door has a closed position for closing the opening, and an open position for opening the opening; and the valve assembly comprises a valve and a reset member, wherein the valve is configured to move relative to the sidewall; and when the box door is located at the closed position, the box door is configured to drive the valve to open the air vent; and when the box door is located at the open position, the reset member is configured to drive the valve to close the air vent;

wherein the valve is movably connected to the sidewall; the valve comprises a first end and a second end in a moving direction of the valve and further comprises an air hole located between the first end of the valve and the second end of the valve and a blocking part located between the first end of the valve and the second end of the valve, and the first end of the valve is adjacent to the opening; and the valve has a first position for making the air hole opposite to the air vent, and a second position for making the blocking part opposite to the air vent; and when the box door is located at the closed position, the box door is configured to abut against the first end of the valve and make the valve move to the first position; and when the box door is located at the open position, the reset member is configured to drive the valve to the second position;

wherein the reset member comprises an elastic member, wherein a first end of the elastic member is connected to the valve, a second end of the elastic member is connected to the inner wall or the sidewall, and the elastic member is configured to make the valve have a tendency to move to the second position;

wherein the valve comprises a main body, a first mounting part disposed at the first end of the valve, and a second mounting part disposed at the second end of the valve, the air hole is disposed on the main body, and a part of the main body where the air hole is not disposed forms the blocking part; and the box body further comprises a limiting member fixedly connected with the sidewall, the first mounting part is connected to the limiting member in an inserted manner, and the second mounting part is connected to the inner wall in an inserted manner; and when the box door is located at the closed position, the first mounting part is configured to abut against the box door, and when the box door is located at the open position, the elastic member is configured to drive the valve to move towards the opening.

2. The locker with the valve assembly according to claim 1, wherein the second mounting part is a strip-shaped structure that extends in a direction perpendicular to the inner wall, the elastic member is a compression spring, the compression spring sleeves on the second mounting part, and one end of the compression spring and another end of the compression spring are configured to abut against the main body and the inner wall respectively.

3. The storage cabinet with the valve assembly according to claim 2, wherein the sidewall comprises a first sidewall and a second sidewall disposed opposite to each other in a width direction of the box body, wherein the first sidewall is adjacent to the main air duct, the air vent is disposed on the first sidewall, and the valve is movably connected to the first sidewall; and the box door is pivoted to the box body through a pivot, the pivot is adjacent to the second sidewall; and when the box door is located at the closed position, an end of the box door facing away from the pivot is configured to abut against the first end of the valve.

4. The storage cabinet with the valve assembly according to claim 2, wherein the main air duct comprises an air inlet duct and an air return duct, and the air vent comprises an air inlet vent and an air outlet vent, wherein the air inlet vent communicates with the air inlet duct, and the air outlet vent communicates with the air return duct; and the air hole comprises an air inlet hole and an air outlet hole, wherein when the box door is located at the closed position, the air inlet hole is opposite to the air inlet vent, and the air outlet hole is opposite to the air outlet vent; and when the box door is located at the open position, the air inlet vent and the air outlet vent are each opposite to the blocking part.

5. The storage cabinet with the valve assembly according to claim 2, wherein the sidewall is provided with a long groove extending in a direction perpendicular to the inner wall, and the valve is disposed in the long groove and configured to move between the first position and the second position along the long groove.

6. The locker with the valve assembly according to claim 1, wherein the sidewall comprises a first sidewall and a second sidewall disposed opposite to each other in a width direction of the box body, wherein the first sidewall is adjacent to the main air duct, the air vent is disposed on the first sidewall, and the valve is movably connected to the first sidewall; and the box door is pivoted to the box body through a pivot, the pivot is adjacent to the second sidewall; and when the box door is located at the closed position, an end of the box door far away facing away from the pivot is configured to abut against the first end of the valve.

7. The locker with the valve assembly according to claim 1, wherein the main air duct comprises an air inlet duct and an air return duct, and the air vent comprises an air inlet vent and an air outlet vent, wherein the air inlet vent communicates with the air inlet duct, and the air outlet vent communicates with the air return duct; and the air hole comprises an air inlet hole and an air outlet hole, wherein when the box door is located at the closed position, the air inlet hole is opposite to the air inlet vent, and the air outlet hole is opposite to the air outlet vent; and when the box door is located at the open position, the air inlet vent and the air outlet vent are each opposite to the blocking part.

8. The locker with the valve assembly according to claim 7, wherein a plurality of air inlet vents are disposed, a plurality of air inlet holes are disposed, a number of the plurality of air inlet holes is the same as a number of the plurality of air inlet vents, and when the box door is located at the closed position, each of the air inlet holes is opposite to a respective one of the plurality of air inlet vents.

9. The storage cabinet with the valve assembly according to claim 8, wherein a plurality of air outlet vents are disposed, a plurality of air outlet holes are disposed, a number of the plurality of air outlet holes is the same as a number of the plurality of air outlet vents, and when the box door is located at the closed position, each of the air outlet holes is opposite to a respective one of the plurality of air outlet vents.

10. The locker with the valve assembly according to claim 7, wherein a plurality of air outlet vents are disposed, a plurality of air outlet holes are disposed, a number of the plurality of air outlet holes is the same as a number of the plurality of air outlet vents, and when the box door is located at the closed position, each of the air outlet holes is opposite to a respective one of the plurality of air outlet vents.

11. The locker with the valve assembly according to claim 1, wherein the main air duct comprises an air inlet duct and an air return duct, and the air vent comprises an air inlet vent and an air outlet vent disposed apart in a vertical direction, wherein the air inlet vent communicates with the air inlet duct, and the air outlet vent communicates with the air return duct; and the valve assembly comprises a first valve assembly and a second valve assembly, wherein when the box door is located at the closed position, an air hole of the first valve assembly is opposite to the air inlet vent, and an air hole of the second valve assembly is opposite to the air outlet vent; and when the box door is located at the open position, a blocking part of the first valve assembly is opposite to the air inlet vent, and a blocking part of the second valve assembly is opposite to the air outlet vent.

12. The locker with the valve assembly according to claim 1, wherein the sidewall is provided with a long groove extending in a direction perpendicular to the inner wall, and the valve is disposed in the long groove and configured to move between the first position and the second position along the long groove.

13. The locker with the valve assembly according to claim 12, wherein the sidewall comprises a housing, the long groove is formed by the housing, and the housing comprises a first plate, a second plate and a third plate vertically connected in sequence, wherein the first plate and the third plate are disposed opposite to each other, and the valve is located between the first plate and the third plate.

14. The locker with the valve assembly according to claim 13, wherein the second plate is provided with a plurality of positioning pins, and the valve is provided with a plurality of limiting grooves, wherein the plurality of limiting grooves extend in the moving direction of the valve, and each of the plurality of limiting grooves sleeves on a respective one of the plurality of positioning pins.

15. The locker with the valve assembly according to claim 14, wherein the reset member is a compression spring located in one limiting groove of the plurality of limiting grooves, wherein one end of the compression spring is configured to abut against an inner wall of the one limiting groove, another end of the compression spring is configured to abut against one positioning pin of the plurality of positioning pins sleeved on by the one limiting groove of the plurality of limiting grooves, and under an action of the compression spring, the valve has a tendency to move to the second position.

16. The locker with the valve assembly according to claim 15, wherein the first plate and the third plate are each provided with a hook, an opening of the hook faces the inner wall, the sidewall is provided with a groove, and the hook is configured to engage with the groove in a snap-in manner.

17. A locker with a valve assembly, comprising a locker body and an air supply assembly disposed on the locker body, and a main air duct communicating with the air supply assembly is disposed inside the locker body; the locker body comprises at least one storage box, each of the at least one storage box comprises a box body, a box door and the valve assembly, the box body comprises a sidewall that surrounds a circle and further comprises an inner wall connected to a rear end of the sidewall, a front end of the sidewall forms an opening, and the sidewall is provided with an air vent communicating with the main air duct; the box door has a closed position for closing the opening, and an open position for opening the opening; and the valve assembly comprises a valve and a reset member, wherein the valve is configured to move relative to the sidewall; and when the box door is located at the closed position, the box door is configured to drive the valve to open the air vent; and when the box door is located at the open position, the reset member is configured to drive the valve to close the air vent;

wherein the valve is movably connected to the sidewall; the valve comprises a first end and a second end in a moving direction of the valve and further comprises an air hole located between the first end of the valve and the second end of the valve and a blocking part located between the first end of the valve and the second end of the valve, and the first end of the valve is adjacent to the opening; and the valve has a first position for making the air hole opposite to the air vent, and a second position for making the blocking part opposite to the air vent; and when the box door is located at the closed position, the box door is configured to abut against the first end of the valve and make the valve move to the first position; and when the box door is located at the open position, the reset member is configured to drive the valve to the second position;

wherein the main air duct comprises an air inlet duct and an air return duct, and the air vent comprises an air inlet vent and an air outlet vent, wherein the air inlet vent communicates with the air inlet duct, and the air outlet vent communicates with the air return duct; and the air hole comprises an air inlet hole and an air outlet hole, wherein when the box door is located at the closed position, the air inlet hole is opposite to the air inlet vent, and the air outlet hole is opposite to the air outlet vent; and when the box door is located at the open position, the air inlet vent and the air outlet vent are each opposite to the blocking part.

* * * * *